US010635044B2

(12) United States Patent
Nemoto

(10) Patent No.: US 10,635,044 B2
(45) Date of Patent: Apr. 28, 2020

(54) RETAINING MEMBER AND IMAGE FORMING APPARATUS INCLUDING SAME

(71) Applicant: KYOCERA Document Solutions Inc., Osaka (JP)

(72) Inventor: Shinji Nemoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/549,879

(22) Filed: Aug. 23, 2019

(65) Prior Publication Data

US 2020/0064771 A1 Feb. 27, 2020

(30) Foreign Application Priority Data

Aug. 27, 2018 (JP) ..... 2018-158588

(51) Int. Cl.
*G03G 15/00* (2006.01)
*G03G 21/16* (2006.01)
*B65H 5/06* (2006.01)

(52) U.S. Cl.
CPC ..... *G03G 21/1647* (2013.01); *B65H 5/06* (2013.01); *G03G 15/5008* (2013.01); *G03G 15/757* (2013.01); *B65H 2404/15* (2013.01); *B65H 2404/16* (2013.01); *B65H 2801/03* (2013.01)

(58) Field of Classification Search
CPC ..... G03G 21/1647; G03G 15/5008; G03G 15/757; B65H 5/06; B65H 2404/15; B65H 2404/16; B65H 2801/03
See application file for complete search history.

(56) References Cited

U.S. PATENT DOCUMENTS 8,827,369 B2 * 9/2014 Izawa ..... A47C 7/54 297/411.32
10,139,775 B2 * 11/2018 Nemoto ..... F16C 35/063
2018/0088517 A1 3/2018 Nemoto et al. ..... 15/757

FOREIGN PATENT DOCUMENTS

JP 2000-321836 A 11/2000
JP 2018-54722 A 4/2018

* cited by examiner

*Primary Examiner* — Hoang X Ngo
(74) *Attorney, Agent, or Firm* — Stein IP, LLC

(57) ABSTRACT

A retaining member has annular inner and outer circumferential portions, a connection portion, engagement projections, a slit, a grip portion, a first inclined surface, and a second inclined surface. The engagement projections projects from a shaft-facing surface of the inner circumferential surface. The slit is formed in the inner circumferential portion. The grip portion projects outward in the radial direction from an outer rim of the outer circumferential portion. The first inclined surface is formed at an upstream-side end part of the grip portion with respect to a direction of fitting to the shaft to be inclined outward in the radial direction from upstream side to downstream side in the fitting direction. The second inclined surface is formed at a downstream-side end part of the grip portion to be inclined outward in the radial direction from downstream side to upstream side in the fitting direction.

11 Claims, 14 Drawing Sheets

RETAINING MEMBER AND IMAGE FORMING APPARATUS INCLUDING SAME

INCORPORATION BY REFERENCE

This application is based upon and claims the benefit of priority from the corresponding Japanese Patent Application No. 2018-158588 filed on Aug. 27, 2018, the entire contents of which are incorporated herein by reference.

BACKGROUND

The present disclosure relates to a retaining member for preventing undesired detachment of a roller, a shaft, and a gear provided around the roller or the shaft in a drive unit, and image forming apparatuses, such as a copier, a printer, a facsimile machine, and a multifunction peripheral having functions of these, which are provided with such a retaining member.

In conventional image forming apparatuses, such as copiers and printers, a drive transmission mechanism composed of a gear, a shaft, and the like for transmitting a rotational driving force of a drive unit is used to transmit the rotational driving force to rotary bodies such as a photosensitive drum, a developing roller, and the like, which are driven members. In such a drive transmission mechanism, as a method to prevent undesired detachment of a roller, a shaft, and a gear provided around them, there has been used a method in which a retaining ring such as an E-ring is provided around the shaft.

As for image forming apparatuses, there has been an increasing demand for compactness, and this puts a strict restriction on the design of the drive transmission mechanism in terms of space. In the method where the conventional retaining member such as an E-ring is used, it is necessary to fit the retaining member from a radial direction of a roller or a shaft, and this disadvantageously requires a space in the radial direction for the fitting and makes the attaching/detaching operations disadvantageously complicated. Furthermore, end parts of the roller and the shaft are exposed, and this disadvantageously allows leakage of bearing grease at the end parts.

There is also known a gear retaining structure in which a gear is fitted to a fixed shaft standing on a plate-shaped member made of resin, and an elastically deformable claw-shaped projection projecting from the plate-shaped member is provided, such that a claw part of the claw-shaped projection engages with a rim of the gear fitted to the fixed shaft.

There is also known a retaining member which has inner and outer circumferential portions, a connection portion, a plurality of engagement projections, and a slit, and which is integrally formed of an elastically deformable material. To fit the retaining member to a shaft, it is pushed from the axial direction of the shaft to open the slit and elastically deform the inner circumferential portion, and the engagement projections are engaged with an engagement groove. To remove the retaining member from the shaft, it is pulled in the axial direction of the shaft while also being pulled in the radial direction of the shaft such that the inner circumferential portion is elastically deformed.

SUMMARY

According to an aspect of the present disclosure, a retaining member is integrally formed of an elastically deformable material, fitted to an end part of a shaft supported by a holding member to prevent detachment of the shaft from the holding member or to prevent detachment of a rotary body provided around the shaft. The retaining member includes inner and outer circumferential portions, a connection portion, a plurality of engagement projections, a slit, a grip portion, a first inclined surface, and a second inclined surface. The inner and outer circumferential portions are annular, and the outer circumferential portion is arranged outside the inner circumferential portion in the radial direction. The connection portion connects the inner and outer circumferential portions to each other in the radial direction. The plurality of engagement projections project from a shaft-facing surface of the inner circumferential portion, and engage with an engagement groove formed in an outer circumferential surface of the shaft. The slit is formed at one or more positions in the inner circumferential portion so as to cut the inner circumferential portion in the radial direction. The grip portion projects outward in the radial direction from an outer rim of the outer circumferential portion. The first inclined surface is formed on an upstream-side end part of the grip portion with respect to a direction of fitting to the shaft, and is inclined outward in the radial direction from upstream side to downstream side in the direction of fitting to the shaft. The second inclined surface is formed on a downstream-side end part of the grip portion with respect to the direction of fitting to the shaft, and is inclined outward in the radial direction from downstream side to upstream side in the direction of fitting to the shaft.

Still other objects of the present disclosure and specific advantages provided by the present disclosure will become further apparent from the following descriptions of embodiments.

DETAILED DESCRIPTION

Figure 1:
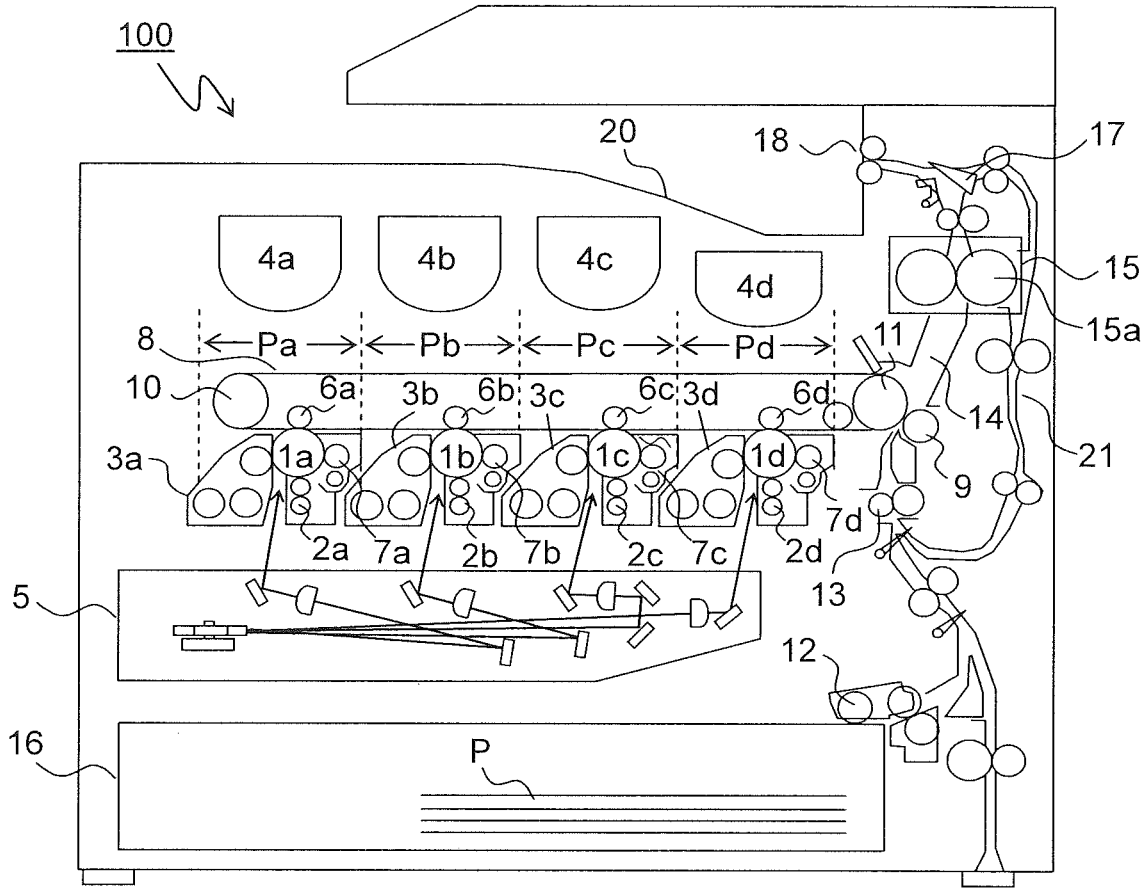
FIG. 1 is a schematic sectional view showing an overall configuration of a color printer provided with a retaining member of the present disclosure.

Hereinafter, embodiments of the present disclosure will be described with reference to the accompanying drawings. FIG. 1 is a schematic sectional view of an image forming apparatus provided with a retaining member 41 of the present disclosure, and the image forming apparatus shown herein is a tandem-type color printer. In a main body of a color printer 100, four image forming portions Pa, Pb, Pc, and Pd are arranged in this order from an upstream side in a conveyance direction (the left side in FIG. 1). These image forming portions Pa to Pd are provided corresponding to images of four different colors (cyan, magenta, yellow, and black), and sequentially form images of cyan, magenta, yellow, and black through charging, exposure, developing, and transfer processes.

The image forming portions Pa to Pd are each provided with a corresponding one of photosensitive drums 1*a*, 1*b*, 1*c*, and 1*d*, which each carry a visible image (a toner image) of a corresponding color, and furthermore, an intermediate transfer belt 8, which rotates in a counterclockwise direction in FIG. 1, is provided adjacent to the image forming portions Pa to Pd.

When image data is fed from a host device such as a personal computer, chargers 2*a* to 2*d* first charge surfaces of the photosensitive drums 1*a* to 1*d* uniformly. Then, an exposure device 5 irradiates the photosensitive drums 1*a* to 1*d* with light in accordance with the image data to form an electrostatic latent image on each of the photosensitive drums 1*a* to 1*d* in accordance with the image data. Developing devices 3*a* to 3*d* are each filled, by toner containers 4*a* to 4*d*, with a predetermined amount of two-component developer (which hereinafter may be referred to simply as developer) including a toner of a corresponding one of the four colors of cyan, magenta, yellow and black, and the toner included in the developer is supplied by a corresponding one of the developing devices 3*a* to 3*d* onto a corresponding one of the photosensitive drums 1*a* to 1*d* to electrostatically adhere thereto. Thereby, a toner image is formed in accordance with the electrostatic latent image, which has been formed by the exposure to the light emitted from the exposure device 5.

Then, by primary transfer rollers 6*a* to 6*d*, an electric field is applied at a predetermined transfer voltage between the primary transfer rollers 6*a* to 6*d* and the photosensitive drums 1*a* to 1*d*, and the toner images of cyan, magenta, yellow, and black on the photosensitive drums 1*a* to 1*d* are primarily transferred onto the intermediate transfer belt 8. After the primary transfer, residual toner and so on left on the surfaces of the photosensitive drums 1*a* to 1*d* are removed by cleaning devices 7*a* to 7*d*.

A transfer sheet P onto which the toner images are to be transferred is stacked in a sheet cassette 16 disposed in a lower part inside the color printer 100, and is conveyed at a predetermined timing via a sheet feeding roller 12 and a registration roller pair 13 to a nip portion (a secondary transfer nip portion) between the intermediate transfer belt 8 and a secondary transfer roller 9 provided adjacent to the intermediate transfer belt 8. The transfer sheet P onto which the toner images have been transferred is conveyed through a sheet conveyance path 14 to a fixing portion 15.

At the fixing portion 15, the transfer sheet P is heated and pressurized by a fixing roller pair 15*a*, whereby the toner images are fixed on the surface of the transfer sheet P, and thus a predetermined full-color image is formed. The transfer sheet P on which the full-color image has been formed is discharged as it is (or after being directed by a branching portion 17 into a reverse conveyance path 21 and having an image formed on the other side) onto a discharge tray 20 by a discharge roller pair 18.

Figure 2:
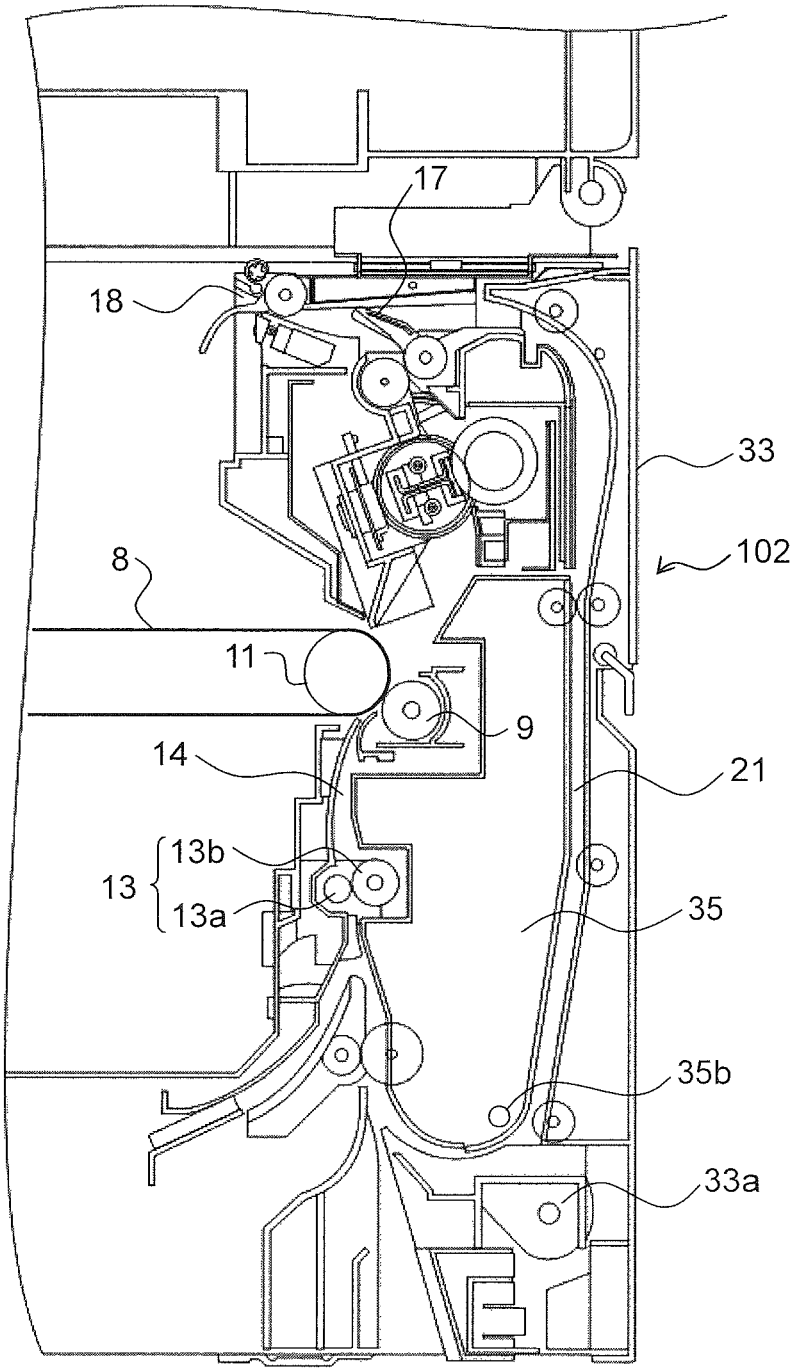
FIG. 2 is a sectional view of an area around a sheet conveyance path and a reverse conveyance path in the color printer shown in FIG. 1.

FIG. 2 is a sectional view of an area around the sheet conveyance path 14 and the reverse conveyance path 21 in the color printer 100 shown in FIG. 1. A side cover 33 constitutes a side surface 102 of the color printer 100, and is rotatably supported by a pivot 33*a* provided in a lower part of the main body of the color printer 100. An inner side of the side cover 33 constitutes one conveyance surface of the reverse conveyance path 21, and a conveyance unit 35 is disposed inside the side cover 33. The conveyance unit 35 is supported in the main body of the color printer 100 to be rotatable about a support shaft 35*b*, and constitutes part of the conveyance surface of the reverse conveyance path 21 and part of a conveyance surface of the sheet conveyance path 14.

The reverse conveyance path 21 extends in an up-down direction along the side surface 102 of the color printer 100 between the side cover 33 and the conveyance unit 35, and is curved into a substantially C-shape to join the sheet conveyance path 14. On an inner side surface of the conveyance unit 35, there are provided a roller 13*b* which is one of rollers constituting the registration roller pair 13 and the secondary transfer roller 9 arranged in this order from an upstream side in the sheet conveyance direction (lower side in FIG. 2). The secondary transfer roller 9 presses a drive roller 11 with the intermediate transfer belt 8 located therebetween.

By rotating only the side cover 33 in an opening direction with respect to the color printer 100, the reverse conveyance path 21 becomes widely exposed. By rotating the side cover 33 together with the conveyance unit 35, the conveyance unit 35 is separated from a color-printer-100-main-body side and the sheet conveyance path 14 becomes widely exposed. On the other hand, by rotating the side cover 33 together with the conveyance unit 35 in a closing direction, the conveyance unit 35 comes into contact with the color-printer-100-main-body side, and the secondary transfer roller 9 is pressed against the drive roller 11 with the intermediate transfer belt 8 located therebetween.

Figure 3:
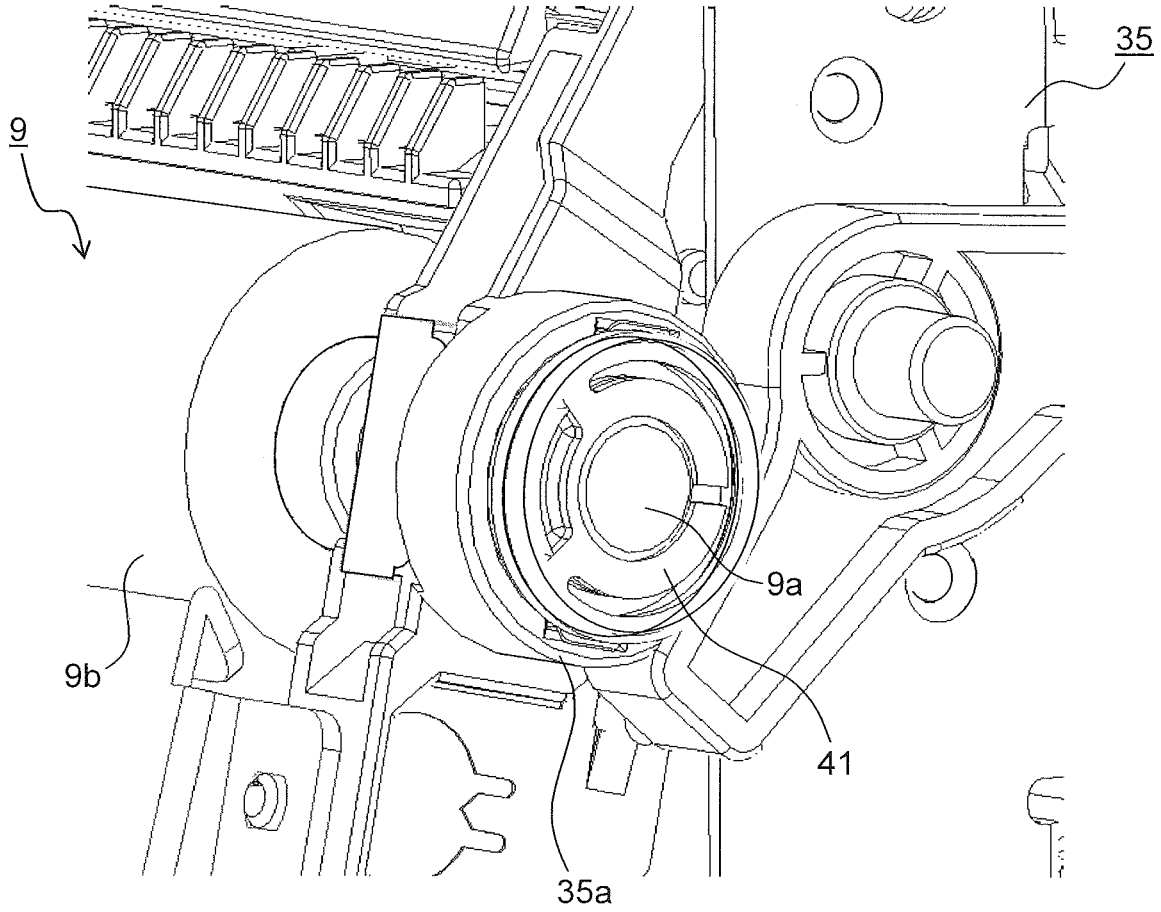
FIG. 3 is an enlarged perspective view of an end side (near side in FIG. 1) of a secondary transfer roller.

FIG. 3 is an enlarged perspective view of an end side (near side in FIG. 1) of the secondary transfer roller 9. The secondary transfer roller 9 is composed of a rotation shaft 9*a*, made of metal, and a roller body 9*b*, made of rubber on an outer circumferential surface of the rotation shaft 9*a*, and one end part of the rotation shaft 9*a* is inserted into a bearing member 40 (see FIG. 7) disposed in a housing 35*a* of the conveyance unit 35. The bearing member 40 is, for example, a rolling bearing (bearing) having balls or rollers therein. Although not illustrated here, the other end side (far side in FIG. 1) of the rotation shaft 9*a* is also rotatably supported by the bearing member 40. Furthermore, a retaining member 41 is fitted to an end surface of the rotation shaft 9*a*.

Figure 4:
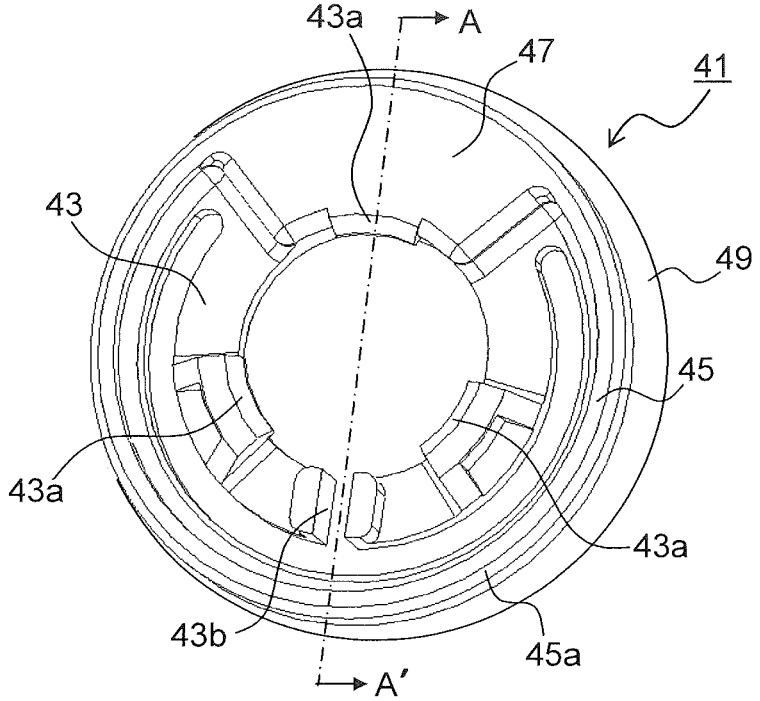
FIG. 4 is a perspective view of a retaining member according to a first embodiment of the present disclosure fitted to one end of the secondary transfer roller, as seen from the side of a rotation-shaft-facing surface of the retaining member.
Figure 5:
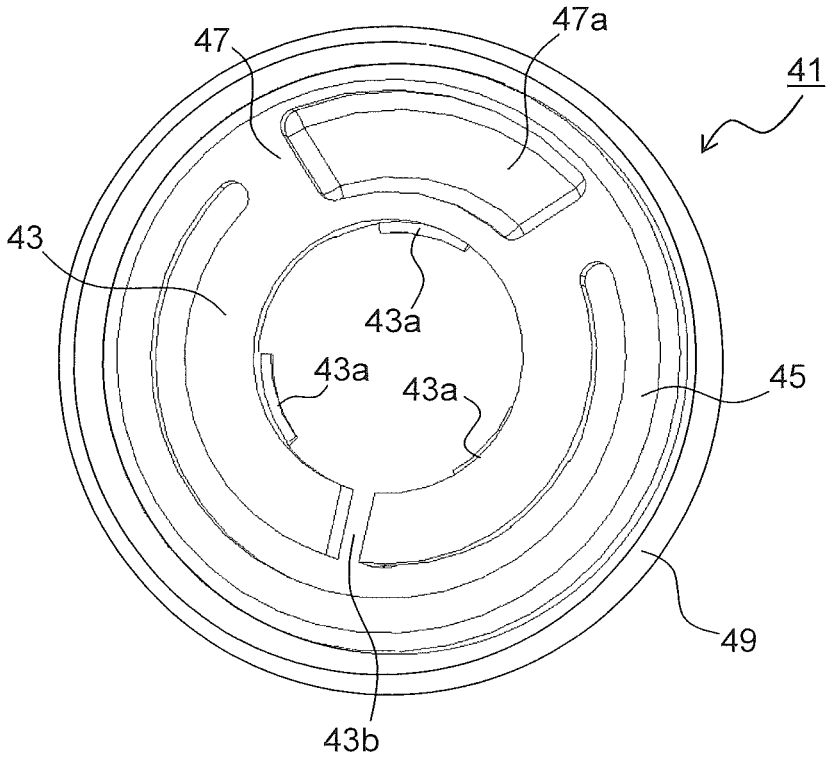
FIG. 5 is a perspective view of the retaining member of the first embodiment, as seen from a side opposite to the side of the rotation-shaft-facing surface of the retaining member.
Figure 6:
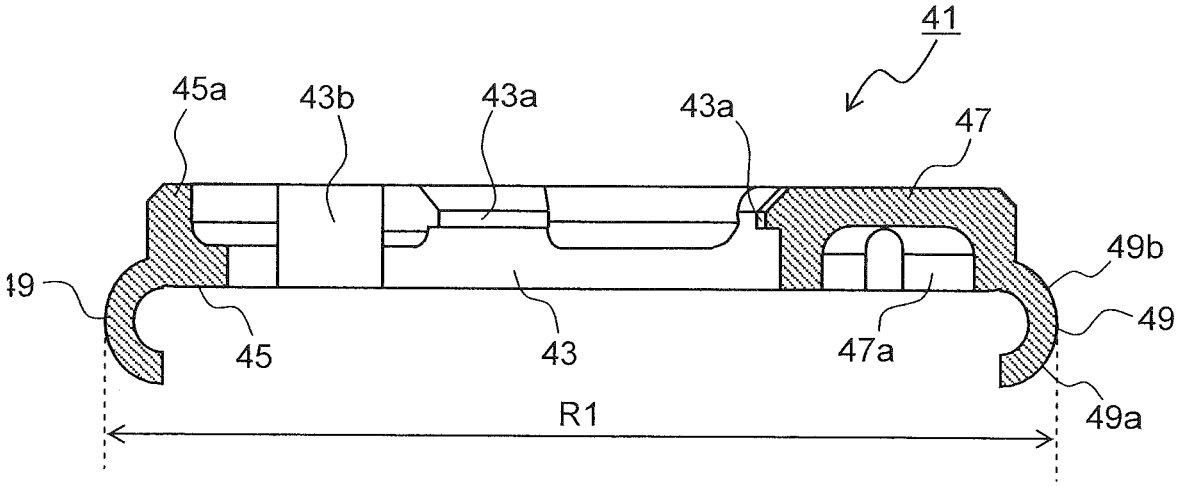
FIG. 6 is a sectional view obtained by cutting the retaining member along a radial direction.

FIG. 4 and FIG. 5 are perspective views of the retaining member 41 according to the first embodiment of the present disclosure fitted to one end of the secondary transfer roller 9, as seen from the side of a rotation-shaft-9*a*-facing surface of the retaining member 41, and as seen from a side opposite to the side of the rotation-shaft-9*a*-facing surface, respectively. FIG. 6 is a sectional view of the retaining member 41 of the first embodiment obtained by cutting it in the radial direction (taken along line AA' in FIG. 4). The retaining member 41 is a member which prevents the rotation shaft 9*a* from coming off from the housing 35*a*, and is integrally formed of ABS resin. It should be noted that the material of the retaining member 41 is not limited to ABS resin, but can also be any elastically deformable material such as other synthetic resins, hard rubber, etc.

The retaining member 41 has an inner circumferential portion 43 and an outer circumferential portion 45, which are both annular, and a connection portion 47 which connects the inner circumferential portion 43 and the outer circumferential portion 45 to each other in the radial direction. In the inner circumferential portion 43, engagement projections 43*a* are formed on a rotation-shaft-9*a*-facing surface. The engagement projections 43*a* are formed at three positions equally spaced from each other along a circumferential direction of the inner circumferential portion 43, ends of the engagement projections 43*a* projecting inward in the radial direction of the inner circumferential portion 43. Furthermore, on a side opposite from the connection portion 47 with respect to a center of the inner circumferential portion 43, a slit 43*b* is formed which cuts the inner circumferential portion 43 in the radial direction. In the connection portion 47, a fan-shaped recessed portion 47*a* is formed in a surface opposite to the rotation-shaft-9*a*-facing surface.

The outer circumferential portion 45 has a diameter that is substantially as long as an outer diameter of the bearing member 40 into which the rotation shaft 9*a* is inserted. The outer circumferential portion 45 includes an annular rib 45*a* along its outer rim so as to project from its surface facing the rotation shaft 9*a* and an annular flange portion 49 formed along its outer rim so as to project in a direction opposite to the direction in which the rib 45*a* projects (that is, toward the upstream side in the fitting direction of the retaining member 41). The flange portion 49 (a grip portion) is so shaped as to be gripped when the retaining member 41 is fitted to the rotation shaft 9*a* by using a robot arm 80 (see FIGS. 8 and 9), as will be described later.

The flange portion 49 has a first inclined surface 49*a* and a second inclined surface 49*b* continuous from the first inclined surface 49*a*. The first inclined surface 49*a* is formed on the upstream side in the fitting direction of the retaining member 41 with respect to the rotation shaft 9*a*, in which the retaining member 41 is moved to be fitted to the rotation shaft 9*a*. The first inclined surface 49*a* is inclined, in an arc shape, outward in the radial direction from upstream side to downstream side in the fitting direction of the retaining member 41 with respect to the rotation shaft 9*a* (that is, in the direction upward from the bottom in FIG. 6). The second inclined surface 49*b* is formed on the downstream side in the fitting direction of the retaining member 41 with respect to the rotation shaft 9*a*, and is inclined, in an arc shape, outward in the radial direction from downstream side to upstream side in the fitting direction of the retaining member 41 with respect to the rotation shaft 9*a* (that is, in the direction in which the retaining member 41 is pulled to be removed from the rotation shaft 9*a*, which is the direction downward from the top in FIG. 6). The diameter of the flange portion 49 is largest at a connection part where the first inclined surface 49*a* and the second inclined surface 49*b* are connected to each other, and the largest diameter R1 of the flange portion 49 is larger than the diameter of the outer circumferential portion 45.

Figure 7:
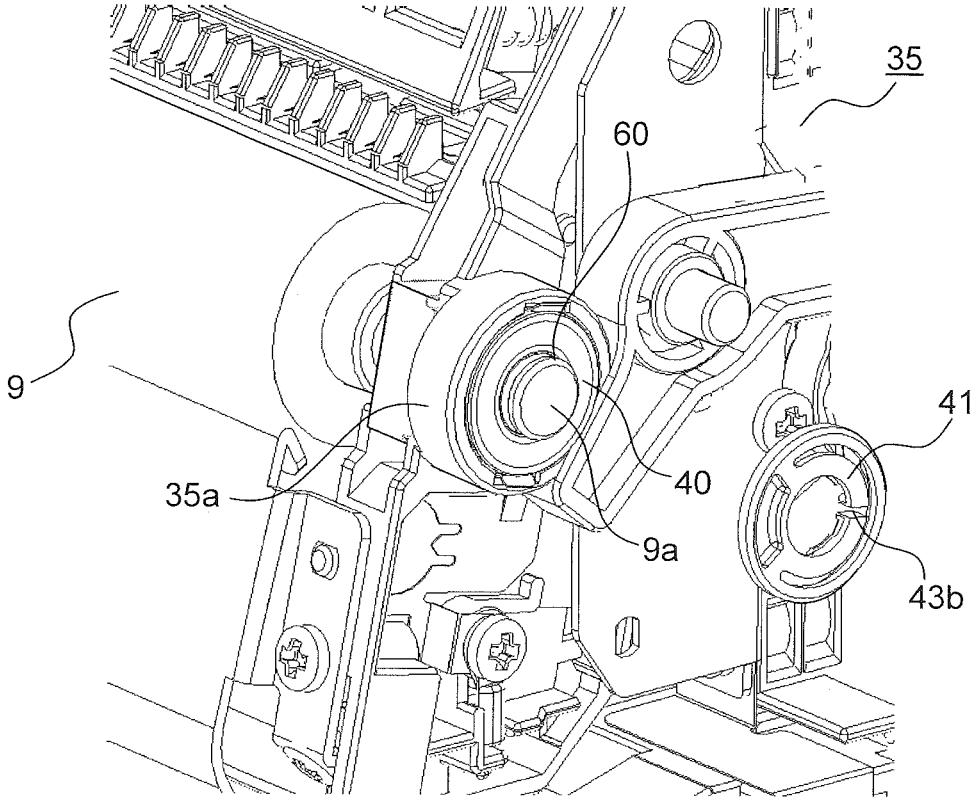
FIG. 7 is a perspective view showing how the retaining member of the first embodiment is fitted to one end of the rotation shaft of the secondary transfer roller.

Next, a description will be given of a method of fitting the retaining member 41 with respect to the rotation shaft 9*a*. FIG. 7 is a perspective view showing how the retaining member 41 of the first embodiment is fitted to one end of the rotation shaft 9*a* of the secondary transfer roller 9. In FIG. 7, the flange portion 49 is not illustrated. First, the rotation shaft 9*a* of the secondary transfer roller 9 is inserted into the bearing member 40 arranged in the housing 35*a*. Then, the retaining member 41 is pushed in the axial direction with respect to an end surface of the rotation shaft 9*a*.

Figure 8:
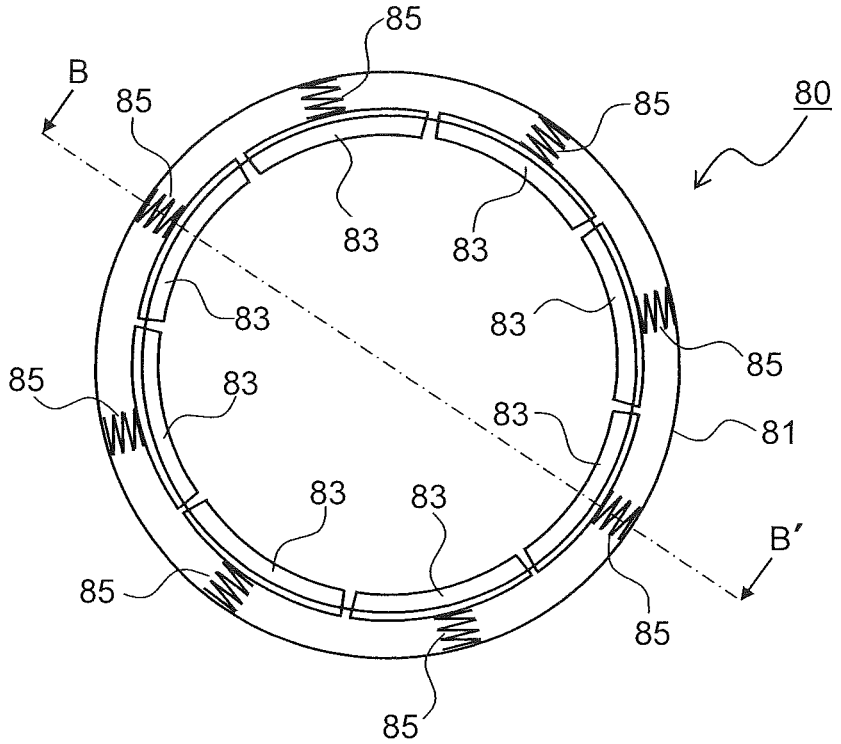
FIG. 8 is a plan view of a robot arm used for the fitting of the retaining member, as seen from below.
Figure 9:
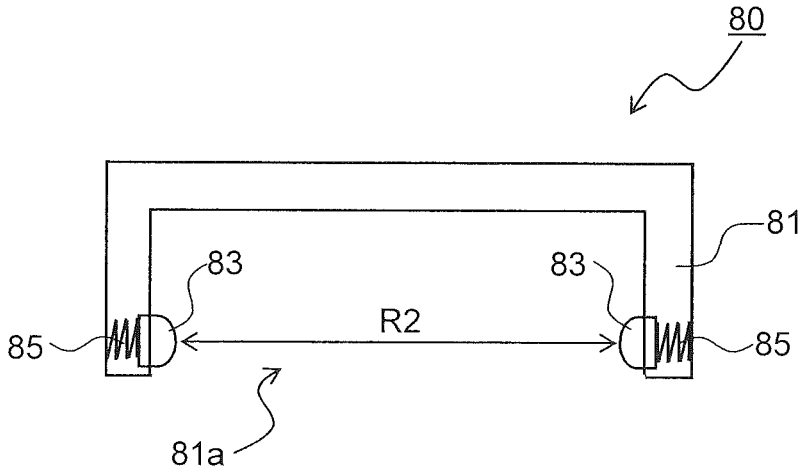
FIG. 9 is a side sectional view of the robot arm.

The retaining member 41 of the present embodiment is fitted to the rotation shaft 9*a* by using the robot arm 80. FIG. 8 is a plan view of the robot arm 80 used in the fitting of the retaining member 41, as seen from below, and FIG. 9 is a side sectional view of the robot arm 80 (a sectional view taken along line BB' of FIG. 8). The robot arm 80 has an arm main body 81, gripping projections 83, and coil springs 85.

The arm main body 81 is cylindrically-shaped and has an opening portion 81*a* at one end thereof. The gripping projections 83 are arranged at positions close to the opening portion 81*a* of the arm main body 81, along an inner circumferential surface of the arm main body 81 (here, the number of the gripping projections 83 is eight). The gripping projections 83 are supported to be movable in the radial direction with respect to the arm main body 81 such that each gripping projection 83 partly projects inward from the inner circumferential surface of the arm main body 81. The coil springs 85 are arranged between the arm main body 81 and the gripping projections 83 to bias the gripping projections 83 inward in the radial direction.

Figure 10:
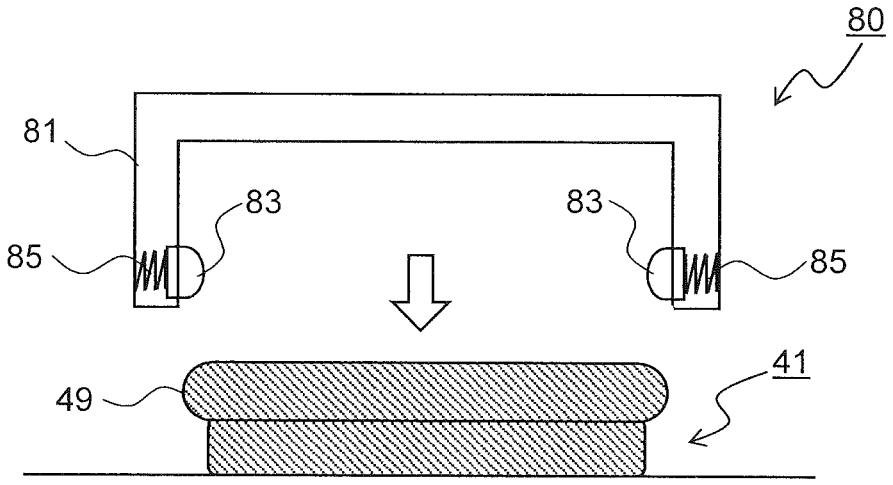
FIG. 10 is a side view schematically showing the fitting procedure of the retaining member, showing a state where the robot arm is going to grasp the retaining member.

FIGS. 10 to 13 are diagrams schematically showing the fitting procedure of the retaining member 41 performed by using the robot arm 80. A description will be given of the fitting procedure of the retaining member 41 with reference to FIGS. 10 to 13, also referring to FIGS. 4 to 9 when necessary. As shown in FIG. 10, the robot arm 80 is moved downward from above the retaining member 41. In the robot arm 80, an interval R2 (see FIG. 9) between each two opposite gripping projections 83 is smaller than the largest diameter R1 (see FIG. 6) of the flange portion 49, and thus the gripping projections 83 come into contact with the first inclined surface 49*a* (see FIG. 6) of the flange portion 49.

When the robot arm 80 is further moved downward, the gripping projections 83 receive reaction force from the first inclined surface 49*a*, whereby the coil springs 85 are compressed. As a result, the gripping projections 83, while being withdrawn outward in the radial direction, move over the first inclined surface 49*a*. When the gripping projections 83 pass over the first inclined surface 49*a*, biasing force (decompressing force) of the compressed coil springs 85 causes the gripping projections 83 to project inward in the radial direction along the second inclined surface 49*b*. As a result, the retaining member 41 is gripped by the robot arm 80.

Figure 11:
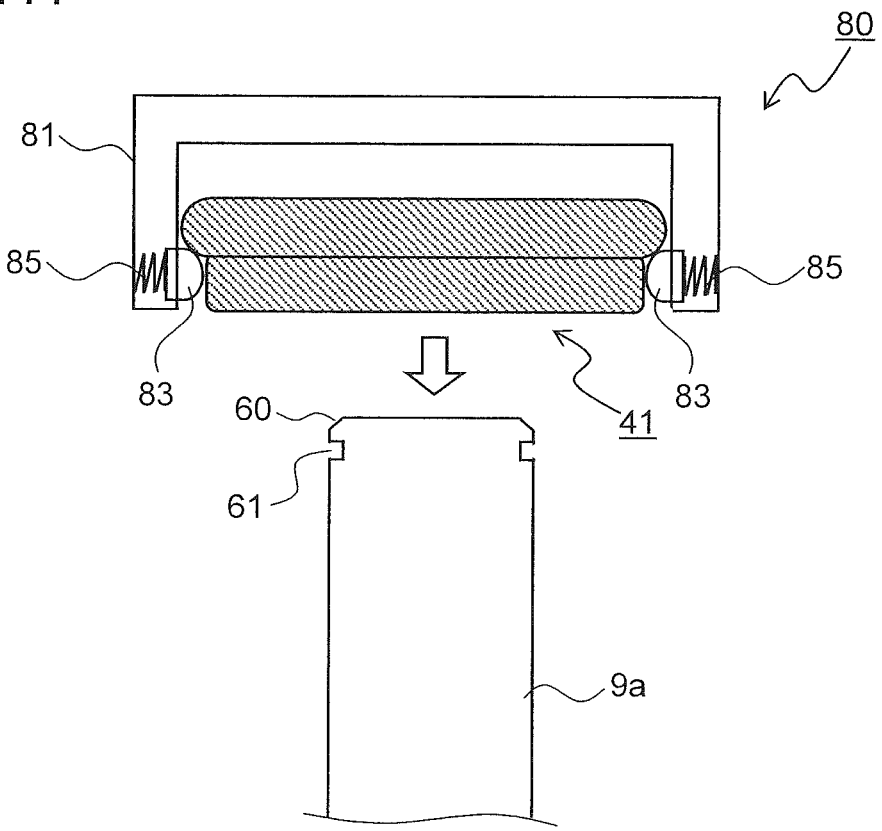
FIG. 11 is a side view schematically showing the fitting procedure of the retaining member, showing a state immediately before the retaining member grasped by the robot arm is fitted to the rotation shaft.

Next, as shown in FIG. 11, the robot arm 80 gripping the retaining member 41 is moved downward from above the rotation shaft 9*a*. The diameter of a circle defined by the ends of the engagement projections 43*a* of the retaining member 41 (see FIG. 5) is smaller than the outer diameter of the rotation shaft 9*a*, and thus the engagement projections 43*a* come into contact with a rim part (a chamfered portion 60) of the end of the rotation shaft 9*a*.

Figure 12:
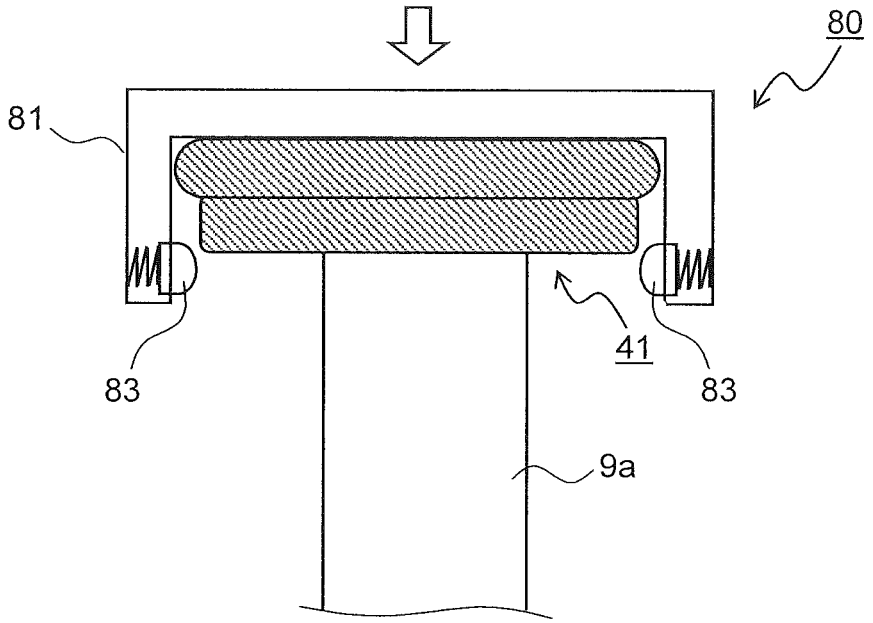
FIG. 12 is a side view schematically showing the fitting procedure of the retaining member, showing how the retaining member is pushed into engagement with the rotation shaft by using the robot arm.

The robot arm 80 continues to be moved downward until the retaining member 41 comes into contact with the end of the rotation shaft 9*a* and then stops being moved downward, and only the robot arm 80 continues to be moved downward until the upper surface of the arm main body 81 comes into contact with the flange portion 49 of the retaining member 41 as shown in FIG. 12.

The robot arm 80 is further moved downward from the state shown in FIG. 12, and then the contact between the engagement projections 43*a* and the rotation shaft 9*a* causes force to act from inside to press and expand the inner circumferential portion 43 (see FIG. 4) outward from inside in the radial direction. As a result, the inner circumferential portion 43 is elastically deformed to open the slit 43*b* wider, and the engagement projections 43*a* are pushed in the axial direction of the rotation shaft 9*a* while being withdrawn outward in the radial direction. Further, since the chamfered portion 60 is formed at the rim part of the end surface of the rotation shaft 9*a*, the engagement projections 43*a* are pushed in the axial direction of the rotation shaft 9*a* along the inclination of the chamfered portion 60.

Figure 14:
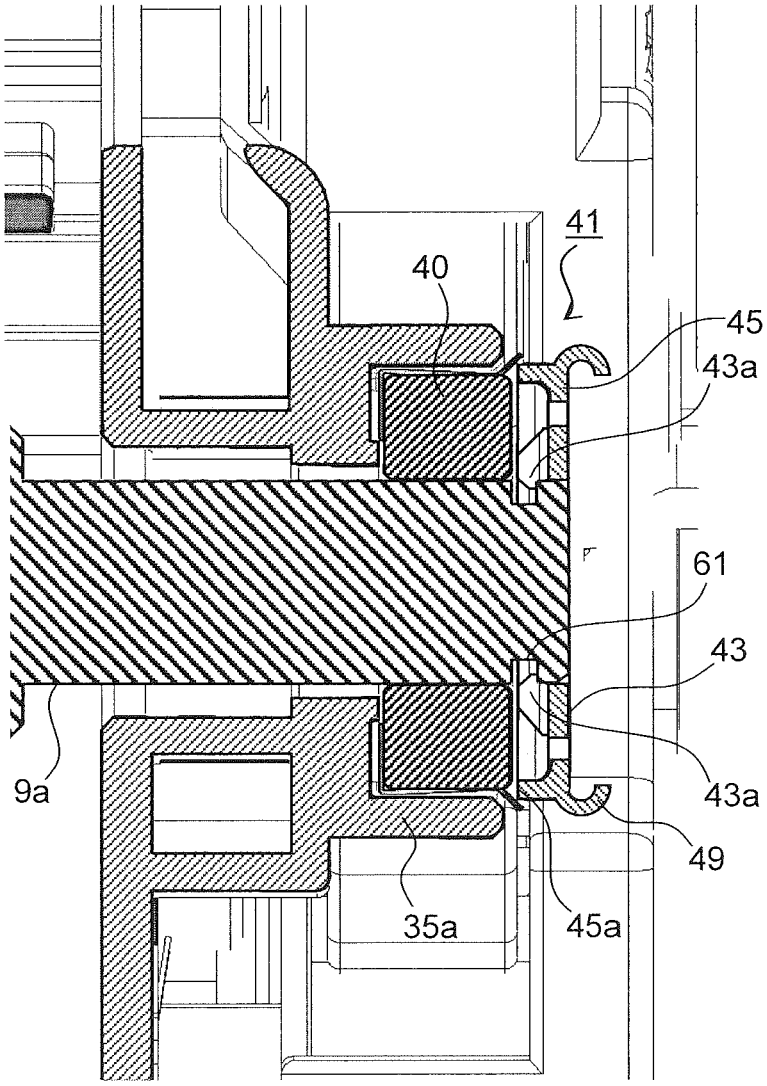
FIG. 14 is a partial sectional view obtained by cutting, along an axial direction of the rotation shaft, an end of the rotation shaft to which the retaining member of the first embodiment has been fitted.

FIG. 14 is a partial sectional view obtained by cutting, along the axial direction of the rotation shaft 9*a*, the end of the rotation shaft 9*a* to which the retaining member 41 of the first embodiment is fitted. When the retaining member 41 is pushed by a predetermined amount for the engagement projections 43*a* to reach an engagement groove 61 formed in the outer circumferential surface of the rotation shaft 9*a*, the inner circumferential portion 43 is made by its own recovery force to shrink inward in the radial direction, to cause the engagement projections 43*a* to engage with the engagement groove 61, and this completes the fitting of the retaining member 41 with respect to the rotation shaft 9*a*.

Figure 13:
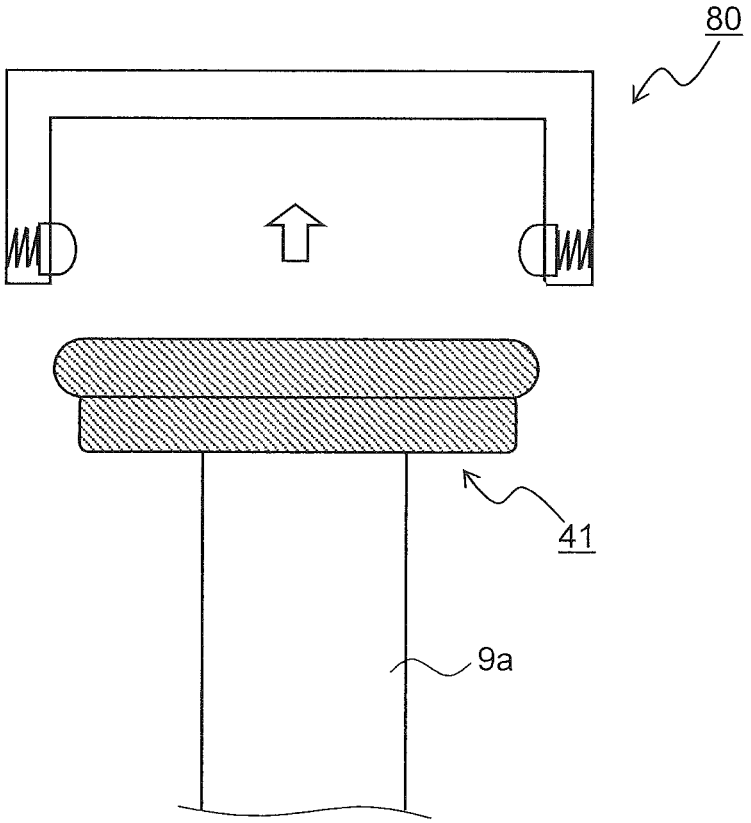
FIG. 13 is a side view schematically showing the fitting procedure of the retaining member, showing how the robot arm is released from the retaining member.

Thereafter, when the robot arm 80 is moved upward, since the retaining member 41 is fastened to the rotation shaft 9*a* by the engagement of the engagement projections 43*a* with the engagement groove 61, the gripping projections 83 receive reaction force from the second inclined surface 49*b* (see FIG. 6), whereby the coil springs 85 are compressed. As a result, the gripping projections 83, while being withdrawn outward in the radial direction, move over the second inclined surface 49*b*. When the gripping projections 83 pass over the second inclined surface 49*b*, the biasing force (the decompressing force) of the compressed coil springs 85 causes the gripping projections 83 to project inward in the radial direction along the first inclined surface 49*a*. Thereby, the retaining member 41 is released from the robot arm 80 as shown in FIG. 13.

Figure 15:
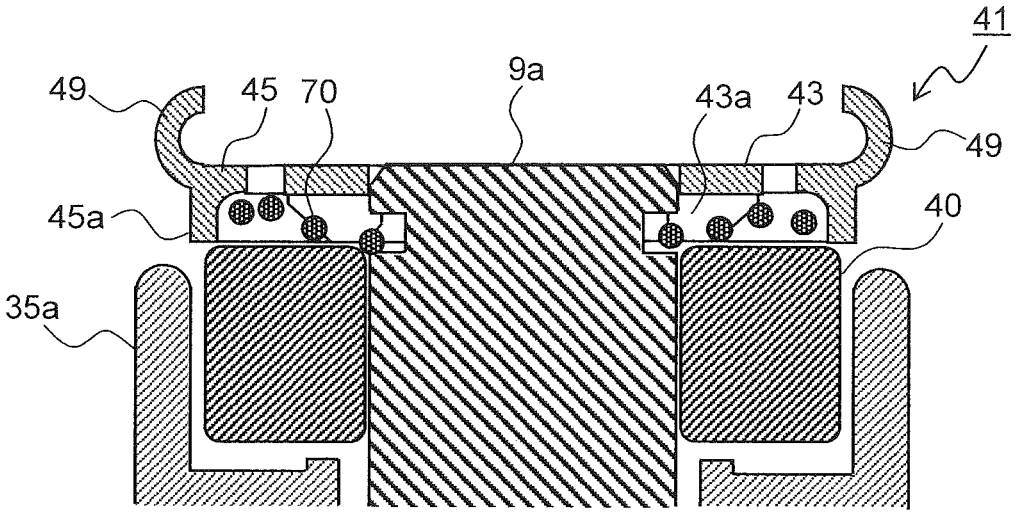
FIG. 15 is an enlarged view of an area near the end of the rotation shaft shown in FIG. 14.

FIG. 15 is an enlarged view of an area near the end of the rotation shaft 9*a* shown in FIG. 14. As shown in FIG. 15, when the retaining member 41 is fitted to the end of the rotation shaft 9*a*, the rib 45*a* of the outer circumferential portion 45 is in contact with an outer rim of the bearing member 40. As a result, an end surface of the bearing member 40 is covered by the retaining member 41, and this makes it possible to reduce leakage of grease (lubricating oil) 70 applied between the bearing member 40 and the rotation shaft 9*a*.

Note that the retaining member 41 has an arc-shaped gap between the inner circumferential portion 43 and the outer circumferential portion 45, and that the slit 43*b* is formed in the inner circumferential portion 43. Hence, the retaining member 41 does not completely seal a space that includes the end surface of the bearing member 40. However, the grease 70 has a relatively high viscosity (a gel), and thus the retaining member 41 of the present embodiment helps effectively reducing the leakage of the grease 70.

To remove the retaining member 41 from the rotation shaft 9*a*, a finger is put in the recessed portion 47*a* formed in the connection portion 47, and then the retaining member 41 is pulled outward in the radial direction. As a result, the inner circumferential portion 43 is elastically deformed to open the slit 43*b* wider, and the engagement projections 43*a* are withdrawn outward in the radial direction, as a result of which the engagement between the engagement projections 43*a* and the engagement groove 61 becomes shallow. Then, the retaining member 41 in this state is pulled out in the axial direction, whereby the retaining member 41 can be easily removed from the rotation shaft 9*a*.

According to the configuration of the present embodiment, the retaining member 41 can be easily fitted to the rotation shaft 9*a* by pushing it in the axial direction of the rotation shaft 9*a*, and can be easily removed from the rotation shaft 9*a* by pulling it in the axial direction of the rotation shaft 9*a*. Accordingly, there is no need of preparing a space in the radial direction for the fitting/removing operation of the retaining member 41, and thus, it is possible to save space without reducing the ease of assembly.

Furthermore, since the end surface of the bearing member 40 is covered by the retaining member 41 when the retaining member 41 is fitted to the rotation shaft 9*a*, it is possible to reduce leakage of the grease 70 from the bearing member 40. Accordingly, even when the user touches a member that he or she can touch when the side cover 33 is open, such as the secondary transfer roller 9, there is no risk of the user having his or her finger stained with leaked grease 70.

Moreover, by providing the retaining member 41 with the flange portion 49 which serves as the grip portion when the retaining member 41 is gripped by the robot arm 80, it becomes possible to fit the retaining member 41 with respect to the rotation shaft 9*a* merely by moving the robot arm 80 downward and upward (linear motion). Accordingly, there is no need of gripping operation (opening and closing operations) to grip the retaining member 41, and this helps achieve a simple configuration and a simple operation control of the robot arm 80.

Furthermore, since the gripping projections 83 of the robot arm 80 smoothly move along the first inclined surface 49*a* and the second inclined surface 49*b* of the flange portion 49, there is no risk of the robot arm 80 failing to grip the retaining member 41 and there is no risk of damage to the gripping projections 83.

Figure 16:
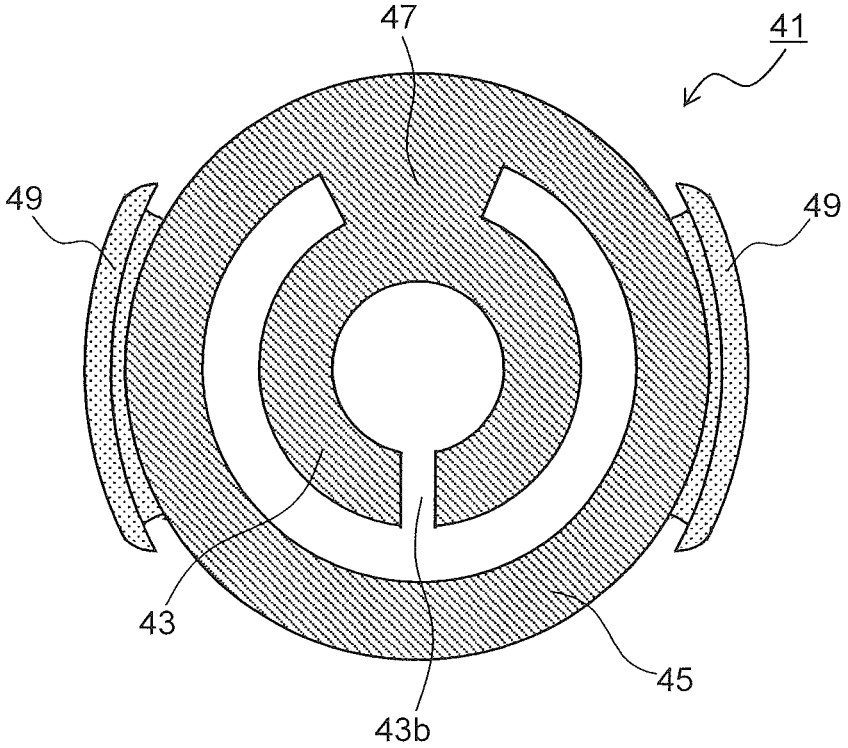
FIG. 16 is a plan view of a modified example of the retaining member of the first embodiment, as seen from a side opposite to the side of the rotation-shaft-facing surface of the retaining member, the modified example having a flange portion formed at each of two opposite positions in an outer rim part.
Figure 17:
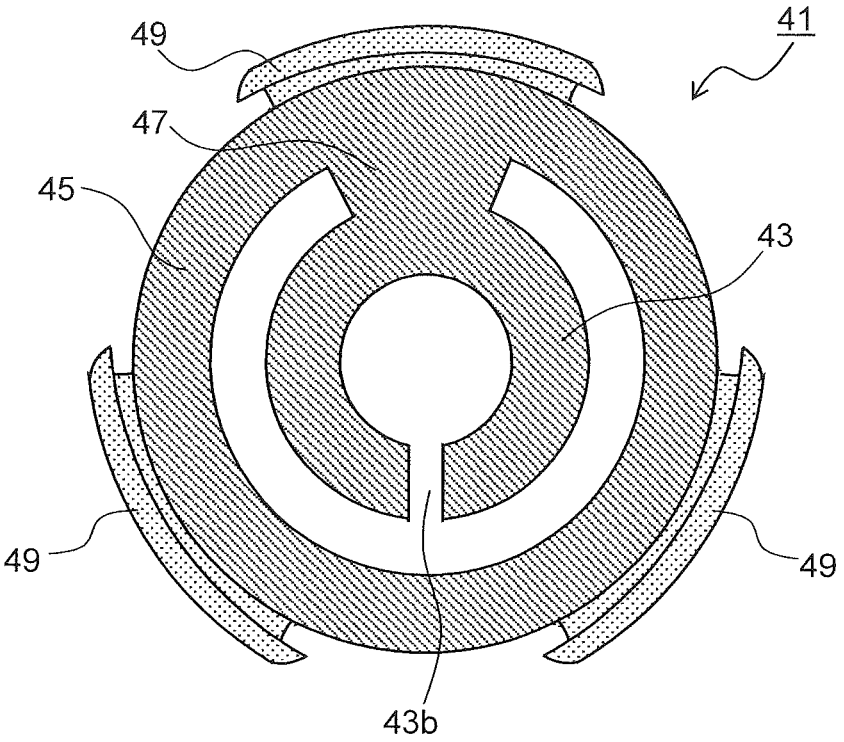
FIG. 17 is a plan view of another modified example of the retaining member of the first embodiment, as seen from a side opposite to the side of the rotation-shaft-facing surface of the retaining member, the modified example having a flange portion at each of three positions in the outer rim part at equal intervals in the circumferential direction.
Figure 18:
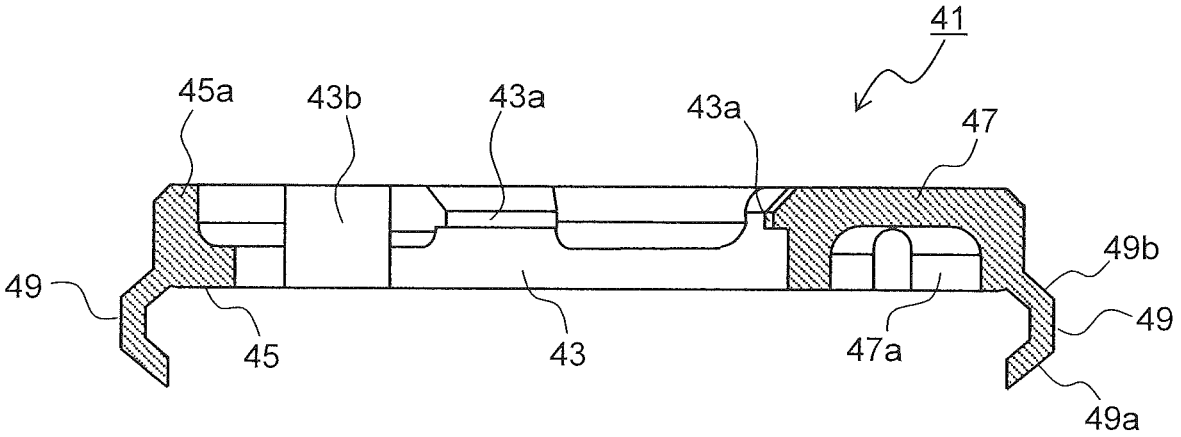
FIG. 18 is a sectional view obtained by cutting still another modified example of the retaining member of the first embodiment in the radial direction, the modified example having a flange portion having a trapezoidal sectional shape.

Here, the flange portion 49 does not necessarily need to be formed over the entire outer rim part of the retaining member 41; for example, as shown in FIG. 16, the flange portion 49 may be formed at least at two opposite positions on the outer rim part, or may be formed, as shown in FIG. 17, at three or more positions on the outer rim part at equal intervals in the circumferential direction. However, even when the gripping projections 83 of the robot arm 80 are partly arranged (for example, only at two positions), if the flange portion 49 is formed over the entire circumference of the outer rim part, there is no need of alignment between the retaining member 41 and the robot arm 80. Further, although the flange portion 49 is formed to have an arc sectional shape in the present embodiment, the flange portion 49 may be formed to have a trapezoidal sectional shape as shown in FIG. 18, having the first inclined surface 49*a* and the second inclined surface 49*b*.

Figure 19:
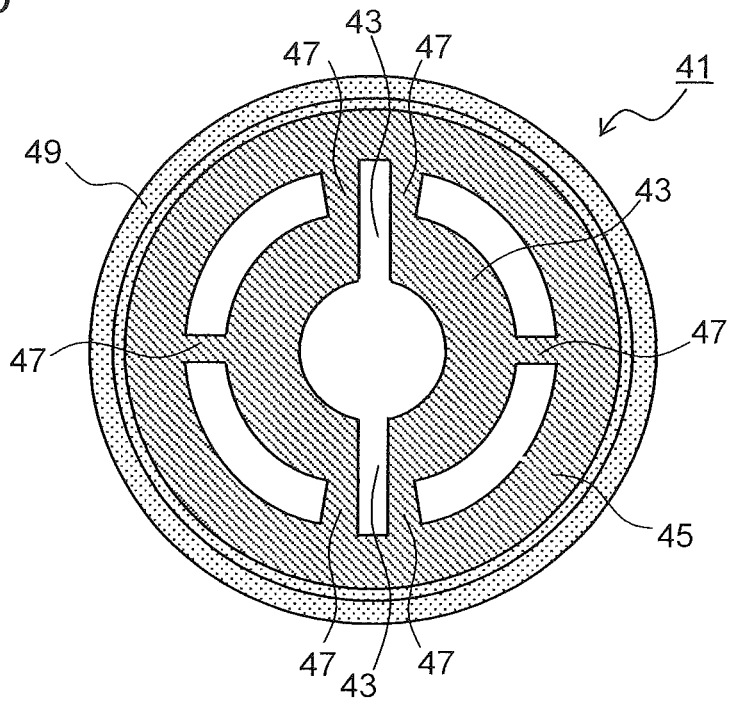
FIG. 19 is a plan view of a retaining member according to a second embodiment of the present disclosure, as seen from a side opposite to the side of a rotation-shaft-facing surface of the retaining member.

FIG. 19 is a plan view of a retaining member 41 according to a second embodiment of the present disclosure, as seen from a side opposite to the side of a rotation-shaft-9*a*-facing surface of the retaining member 41. The retaining member 41 of the present embodiment has an inner circumferential portion 43 that is divided into two parts by slits 43*b* formed at two opposite positions. Further, each of the two parts of the inner circumferential portion 43 is connected to an outer circumferential portion 45 by connection portions 47 formed at a plurality of positions (three positions for each part, thus six positions in total) at equal intervals in the circumferential direction. The configurations of the other portions of the present embodiment, such as a flange portion 49 of the retaining member 41, are similar to those in the first embodiment.

In the retaining member 41 of the present embodiment, since the inner circumferential portion 43 is connected to the outer circumferential portion 45 by the plurality of connection portions 47, in comparison with the first embodiment, the inner circumferential portion 43 is less bendable in fitting the retaining member 41 to the rotation shaft 9*a*. This helps reduce elastic deformation of areas around engagement projections 43*a* in the insertion direction, and thus contributes to stable fitting of the retaining member 41 to the rotation shaft 9*a*.

In the present embodiment, the slits 43*b* are formed at two opposite positions in the inner circumferential portion 43 to thereby divide it into two parts, and each part of the divided inner circumferential portion 43 is connected to the outer circumferential portion 45 by the connection portions 47 formed at three positions at equal intervals in the circumferential direction; however, the slits 43*b* may be formed at three or more positions in the inner circumferential portion 43 in the circumferential direction to thereby divided the inner circumferential portion 43 into three or more parts, and each part of the divided inner circumferential portion 43 may be connected to the outer circumferential portion 45 by the connection portions 47 formed at a plurality of positions at equal intervals in the circumferential direction.

Figure 20:
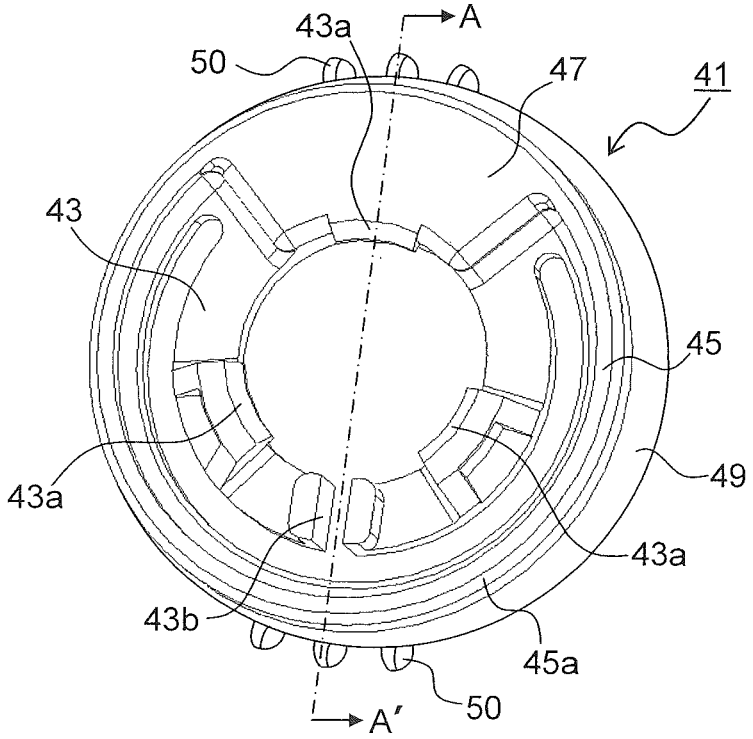
FIG. 20 is a perspective view of a retaining member according to a third embodiment of the present disclosure, as seen from the side of a rotation-shaft-facing surface of the retaining member.
Figure 21:
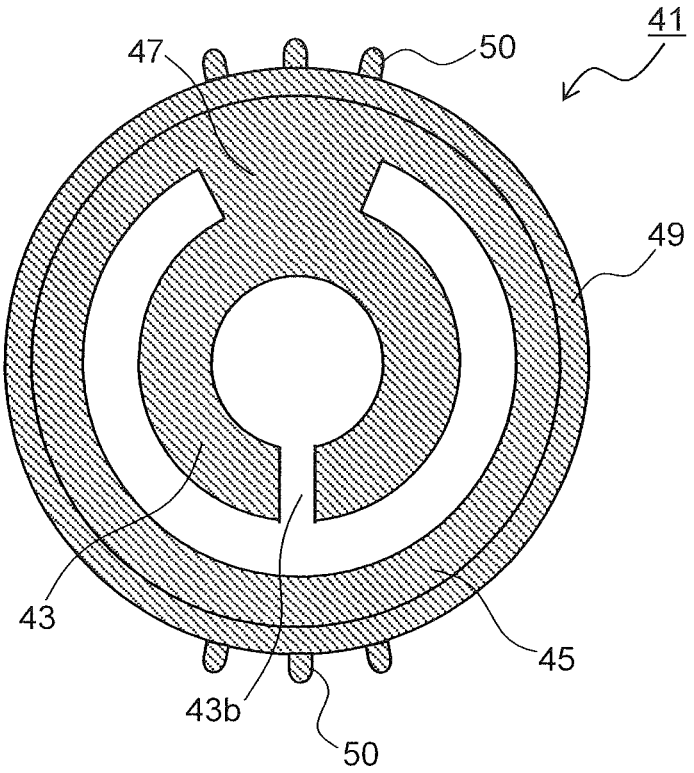
FIG. 21 is a plan view of the retaining member according to the third embodiment, as seen from a side opposite to the side of the rotation-shaft-facing surface of the retaining member.
Figure 22:
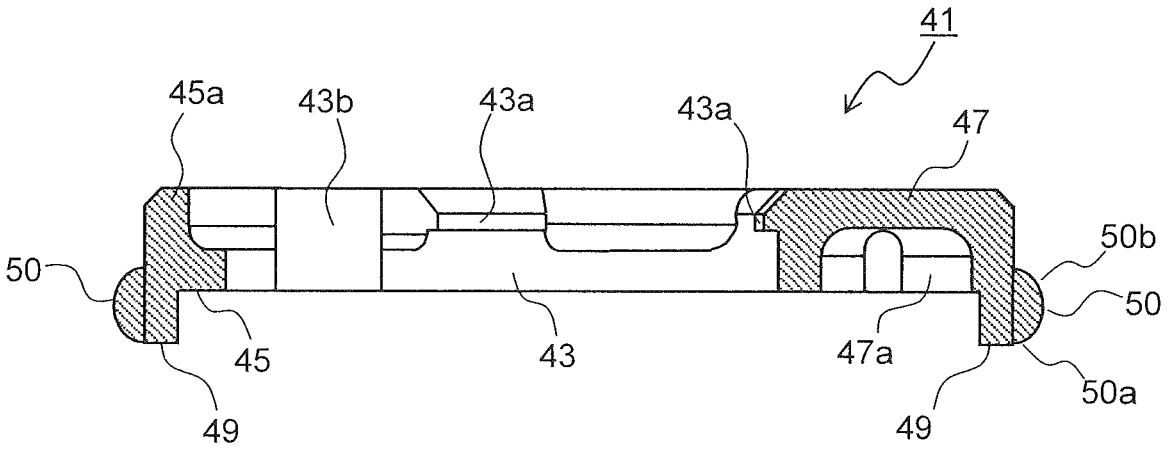
FIG. 22 is a sectional view obtained by cutting the retaining member according to the third embodiment in the radial direction.

FIG. 20 is a perspective view of a retaining member 41 according to a third embodiment of the present disclosure, as seen from the side of a rotation-shaft-9*a*-facing surface of the retaining member 41. FIG. 21 is a plan view of the retaining member 41 according to the third embodiment, as seen from a side opposite to the side of the rotation-shaft-9*a*-facing surface of the retaining member 41. FIG. 22 is a sectional view obtained by cutting the retaining member 41 of the third embodiment in the radial direction (taken along line AA' of FIG. 20). In the retaining member 41 of the present embodiment, a flange portion 49 is formed on a rim part of the outer circumferential portion 45. The flange portion 49 projects in a direction opposite to the direction in which a rib 45*a* projects, and is equal in diameter to the outer circumferential portion 45. At each of two opposite positions on an outer circumferential surface of the flange portion 49, there are formed a plurality of (here, three) engagement protrusion portions 50.

The engagement protrusion portions 50 each have a first inclined surface 50*a* and a second inclined surface 50*b*. The first inclined surface 50*a* is formed on an upstream-side end part of each engagement protrusion portion 50 in the fitting direction of the retaining member 41 with respect to the rotation shaft 9*a*. The first inclined surface 50*a* is inclined, in an arc shape, outward in the radial direction from upstream side to downstream side in the fitting direction of the retaining member 41 with respect to the rotation shaft 9*a* (that is, in the direction upward from the bottom in FIG. 22). The second inclined surface 50*b* is formed on a downstream-side end part of each engagement protrusion portion 50, and is inclined, in an arc shape, outward in the radial direction from downstream side to upstream side in the fitting direction of the retaining member 41 with respect to the rotation shaft 9*a* (that is, in the direction in which the retaining member 41 is pulled to be removed from the rotation shaft 9*a*, which is the direction downward from the top in FIG. 22). The projection amount of the engagement protrusion portion 50 is largest at a connection portion where the first inclined surface 50*a* and the second inclined surface 50*b* are connected to each other. The configurations of the other portions of the retaining member 41 of the present embodiment are similar to those in the first embodiment.

In the present embodiment, by providing the retaining member 41 with the engagement protrusion portions 50 which serve as the grip portion when the retaining member 41 is gripped by the robot arm 80 (see FIGS. 8 and 9), it becomes possible to fit the retaining member 41 with respect to the rotation shaft 9*a* merely by moving the robot arm 80 downward and upward (linear motion) as in the first embodiment. Accordingly, there is no need of gripping operation (opening and closing operations) to grip the retaining member 41, and this helps achieve a simple configuration and a simple operation control of the robot arm 80.

Furthermore, since the gripping projections 83 of the robot arm 80 smoothly move along the first inclined surfaces 50*a* and the second inclined surfaces 50*b* of the engagement protrusion portions 50, there is no risk of the robot arm 80 failing to grip the retaining member 41 and there is no risk of damage to the gripping projections 83.

Figure 23:
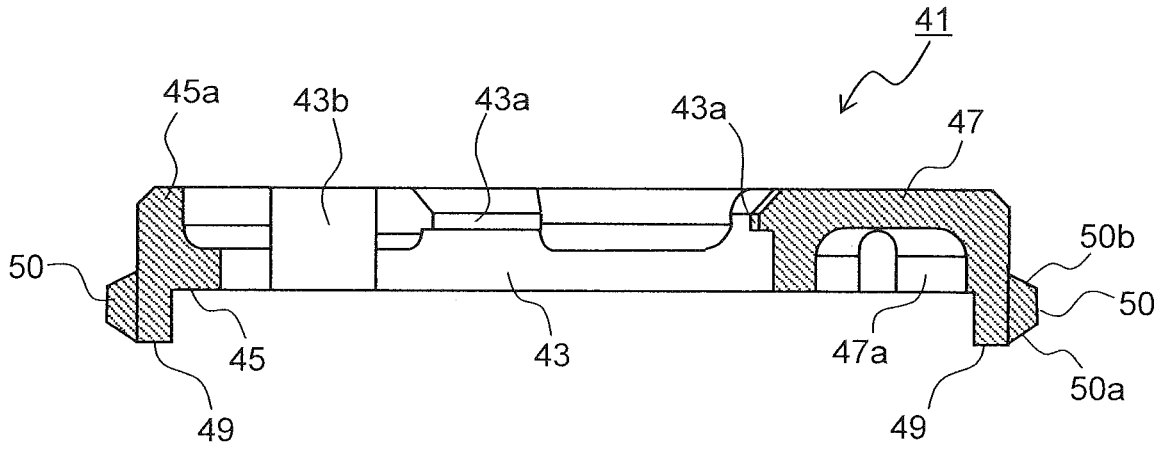
FIG. 23 is a sectional view obtained by cutting a modified example of the retaining member of the third embodiment in the radial direction, the modified example having an engagement protrusion portion having a trapezoidal sectional shape.

Here, although the engagement protrusion portions 50 are formed at two opposite positions on the flange portion 49, the engagement protrusion portions 50 may be formed at three or more positions on the outer rim part at equal intervals in the circumferential direction, or may be formed over the entire area of the flange portion 49 in the circumferential direction. Further, although the engagement protrusion portions 50 are each formed to have an arc sectional shape in the present embodiment, each engagement protrusion portion 50 may be formed to have a trapezoidal sectional shape as shown in FIG. 23, having the first inclined surface 50*a* and the second inclined surface 50*b*.

It should be understood that the present disclosure is not limited to the above embodiments, and various modifications are possible within the scope of the present disclosure. For example, the above embodiments have dealt with cases where the retaining member 41 is fitted with respect to the rotation shaft 9*a* of the secondary transfer roller 9, but the present disclosure is not limited to this, and the retaining member 41 is usable as a retaining member for rotation shafts of other rollers such as the sheet feeding roller 12, the registration roller pair 13, etc.

Figure 24:
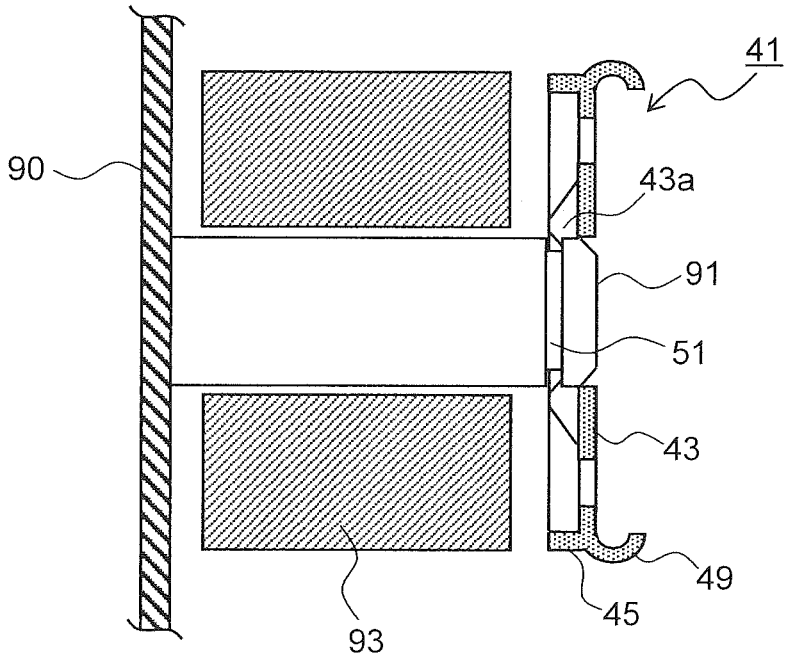
FIG. 24 is a diagram showing an example where a retaining member of the present disclosure is used as a retaining mechanism for an idle gear fitted to a fixed shaft fixed to a frame.

Or, as shown in FIG. 24, in a case where an idle gear 93 is fitted to a fixed shaft 91 fixed to a frame 90, the retaining member 41 can be used as a retaining member for the idle gear 93 by forming an engagement groove 61 in the fixed shaft 91 for the fitting of the retaining member 41.

The present disclosure is usable in image forming apparatuses, such as copiers, printers, facsimile machines, and multifunction peripherals having functions of these. By using the present disclosure, it becomes possible to provide a retaining member that can be easily attached/detached to/from a rotation shaft by a robot arm and that also helps saving space, and an image forming apparatus including such a retaining member.

What is claimed is:

1. A retaining member that is fitted to an end part of a shaft to prevent detachment of the shaft from a holding member or to prevent detachment of a rotary body provided around the shaft, and that is integrally formed of an elastically deformable material, the retaining member comprising:

an inner circumferential portion which is annular and faces the end part of the shaft supported by the holding member;

an outer circumferential portion which is annular and arranged outside the inner circumferential portion in a radial direction;

a connection portion which connects the inner circumferential portion and the outer circumferential portion to each other in the radial direction;

a plurality of engagement projections which project from a shaft-facing surface of the inner circumferential portion, the shaft-facing surface facing the shaft, and which engage with an engagement groove formed in an outer circumferential surface of the shaft;

a slit which is formed at one or more positions in the inner circumferential portion so as to cut the inner circumferential portion in the radial direction;

a grip portion which projects outward in the radial direction from an outer rim of the outer circumferential portion;

a first inclined surface which is formed on an upstream-side end part of the grip portion with respect to a direction of fitting to the shaft, and which is inclined outward in the radial direction from upstream side to downstream side in the direction of fitting to the shaft; and a second inclined surface which is formed on a downstream-side end part of the grip portion with respect to the direction of fitting to the shaft, and which is inclined outward in the radial direction from downstream side to upstream side in the direction of fitting to the shaft.

2. The retaining member according to claim 1, wherein the grip portion is a flange portion which projects from the outer rim of the outer circumferential portion in a direction away from the shaft-facing surface, and which has the first inclined surface and the second inclined surface.

3. The retaining member according to claim 2, wherein the first inclined surface is inclined, in an arc shape, outward in the radial direction from upstream side to downstream side in the direction of fitting to the shaft, the second inclined surface is inclined, in an arc shape, outward in the radial direction from downstream side to upstream side in the direction of fitting to the shaft, and the flange portion has a largest diameter at a connection part at which the first inclined surface and the second inclined surface are connected to each other, the largest diameter of the flange portion being larger than a diameter of the outer circumferential portion.

4. The retaining member according to claim 1, further comprising:

a flange portion which projects from the outer rim of the outer circumference portion in a direction away from the shaft-facing surface, and which is equal in diameter to the outer circumferential portion, wherein the grip portion includes one or more engagement protrusion portions which project outward in the radial direction from an outer circumferential surface of the flange portion, and which each have the first inclined surface and the second inclined surface.

5. The retaining member according to claim 1, wherein the grip portion is formed at least at two opposite positions on the outer rim of the outer circumferential portion.

6. The retaining member according to claim 1, wherein the grip portion is formed at three or more positions on the outer rim of the outer circumferential portion at equal intervals in a circumferential direction.

7. The retaining member according to claim 1, wherein the slit is formed at a plurality of positions in the inner circumferential portion at equal intervals in a circumferential direction, and the inner circumferential portion divided by the slit is connected to the outer circumferential portion by the connection portion formed at a plurality of positions at equal intervals in the circumferential direction.

8. The retaining member according to claim 1, wherein the plurality of engagement projections are formed at equal intervals along a circumferential direction of the inner circumferential portion.

9. The retaining member according to claim 1, wherein a rib is formed in an annular shape along the outer rim of the outer circumferential portion so as to project from the shaft-facing surface, and the rib contacts an end surface of the holding member with the engagement projections engaged with the engagement groove.

10. The retaining member according to claim 1, wherein in the connection portion, a recessed portion is formed on a side opposite to the shaft-facing surface.

11. An image forming apparatus comprising the retaining member according to claim 1.

* * * * *